United States Patent [19]

Terzian et al.

[11] Patent Number: 4,467,555

[45] Date of Patent: Aug. 28, 1984

[54] ANIMATED DOLL

[75] Inventors: Rouben T. Terzian, Chicago; Horst D. Herbstler, Bolingbrook; Walter J. Wozniak, Addison, all of Ill.

[73] Assignee: Marvin Glass & Associates, Chicago, Ill.

[21] Appl. No.: 348,863

[22] Filed: Feb. 16, 1982

[51] Int. Cl.[3] ..... A63H 23/02; A63H 11/10

[52] U.S. Cl. ..... 446/158; 446/276; 446/355

[58] Field of Search ..... 46/92, 101–107, 46/117–119, 149, 150, 108–110, 120, 173, 163, 164, 264–266, 226, 355, 376; 441/56–59

[56] References Cited

U.S. PATENT DOCUMENTS

| | | | |
|---|---|---|---|
| 2,536,390 | 1/1951 | Pobochenko | 441/56 |
| 2,704,416 | 3/1955 | Laird | 46/92 |
| 3,147,566 | 9/1964 | Ong | 46/149 |
| 3,425,154 | 2/1969 | Lindsay et al. | 46/150 |
| 3,475,857 | 11/1969 | Douglas et al. | 46/226 |
| 3,546,814 | 12/1970 | Melendez | 46/101 |
| 3,548,537 | 12/1970 | Robbins | 46/150 |
| 3,638,353 | 2/1972 | Frye et al. | 46/92 |
| 3,693,292 | 9/1972 | DiLeva | 46/92 X |
| 3,922,813 | 12/1978 | Terzian et al. | 46/119 |
| 4,124,950 | 11/1978 | Becker | 46/109 |

FOREIGN PATENT DOCUMENTS

| | | | |
|---|---|---|---|
| 411,629 | 4/1925 | Fed. Rep. of Germany | 46/173 |

*Primary Examiner*—James R. Feyrer

[57] ABSTRACT

A doll that may be actuated to simulate a swimming, walking or kicking action includes a torso with a pair of arms rotatably mounted thereto. A head mounting member is pivotally mounted to the upper portion of the torso and a leg mounting structure is secured to the lower portion of the torso. A pair of legs are pivotally mounted on the leg mounting structure in a manner to allow independent rotation. A compound cam is rotatably mounted in the torso and includes a helical groove in which a pair of cam followers are positioned that are in turn secured to each of the legs. A third cam follower is positioned within the torso to engage an eccentric cam that is part of the compound cam. The third cam follower is mechanically connected to the head mounting member resulting in pivoting of the head. A flotation device is arranged to be engageable by the doll's arms for use in the swimming mode. The doll may also include a wheeled vehicle that supports the doll in a generally vertical orientation while allowing the legs of the doll to engage a surface such as a floor. Movement of the legs propels the doll and the wheeled vehicle over a surface.

15 Claims, 8 Drawing Figures

ANIMATED DOLL

BACKGROUND OF THE INVENTION

A. Field of the Invention

The present invention relates to an action doll and in particular to a new and improved doll capable of action simulating swimming or other motion.

B. Description of the Prior Art

It is known that the more popular types of toy dolls are those that can perform some type of action. Examples of these prior art dolls are walking dolls such as that disclosed in U.S. Pat. No. 4,386,479 and skating dolls such as that disclosed in U.S. Pat. No. 4,305,222. It is also known that dolls that may be used in a body of water such as a bathtub are also enjoyable particularly if the doll is capable of some type of action. Swimming dolls are disclosed, for example, in U.S. Pat. Nos. 3,601,922; 3,464,154; 3,332,165; 3,247,613 and 3,153,879.

SUMMARY OF THE INVENTION

An object of the present invention is to provide a new and improved toy action doll.

Briefly, the present invention is directed to a new and improved toy action doll that simulates the action of a human swimming in a body of water. The toy doll includes a torso to which are pivotally mounted first and second arms. A head mounting member is pivotally mounted to the torso and a leg mounting structure is secured to the torso. First and second legs are independently and pivotally mounted on the leg mounting structure and first and second cam followers are secured the legs. A compound cam is rotatably mounted in the torso and includes a helical groove fabricated in the outer periphery thereof. The first and second cam followers secured to the first and second legs engage the helical groove. A third cam follower is pivotally mounted in the torso and engages an eccentrically mounted cam defined on the compound cam. The third cam follower is mechanically coupled to the head mounting member causing the head mounting member to pivot. A head is mounted on the head mounting member. A negator spring or other motor is positioned within the torso and coupled to the compound cam to rotate the cam. The toy doll may also include a wheeled vehicle on which the toy doll may be seated with the legs engaging a surface such as a floor or the like. The action of moving the legs of the toy doll propels the toy doll and the wheeled vehicle over the surface.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
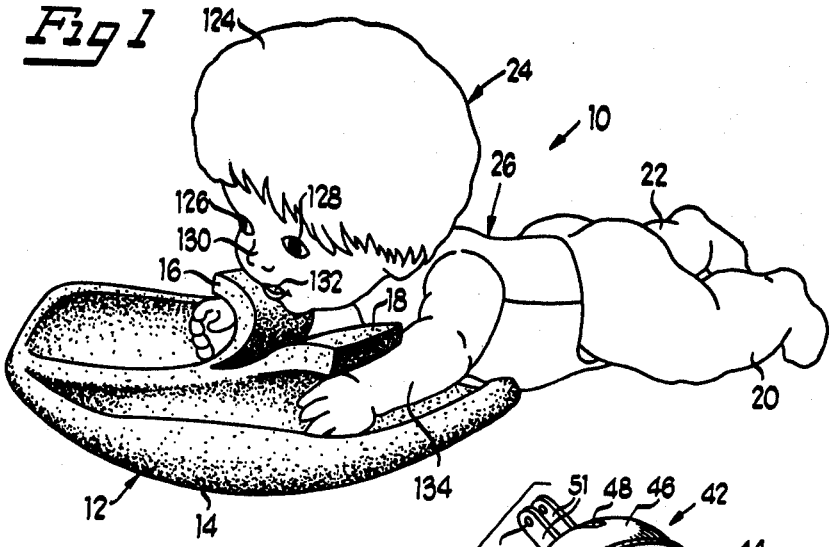
FIG. 1 is a perspective view of a toy doll constructed in accordance with the principles of the present invention.

Referring to the drawings and initially to FIG. 1 there is illustrated a doll generally designated by the reference numeral 10 constructed in accordance with the principles of the present invention. In FIG. 1 the doll 10 is illustrated as secured to a flotation device 12 that may be generally in the form of a kickboard formed of floating material such as foam or the like. The flotation device 12 includes a planar body 14 and a pair of L-shaped handles 16 and 18 that are releasably secured to the doll 10 and allow the top portion of the doll 10 to float.

Upon actuation, the doll 10 will perform a kicking action with the legs 20 and 22 causing the doll 10 and the flotation device 12 to move across the body of water under propulsion of the kicking legs 20 and 22. As the legs 20 and 22 are kicking, the uplifted head of the doll generally designated by the reference numeral 24 pivots resulting in the realistic swimming appearance of the doll 10.

Figure 2:
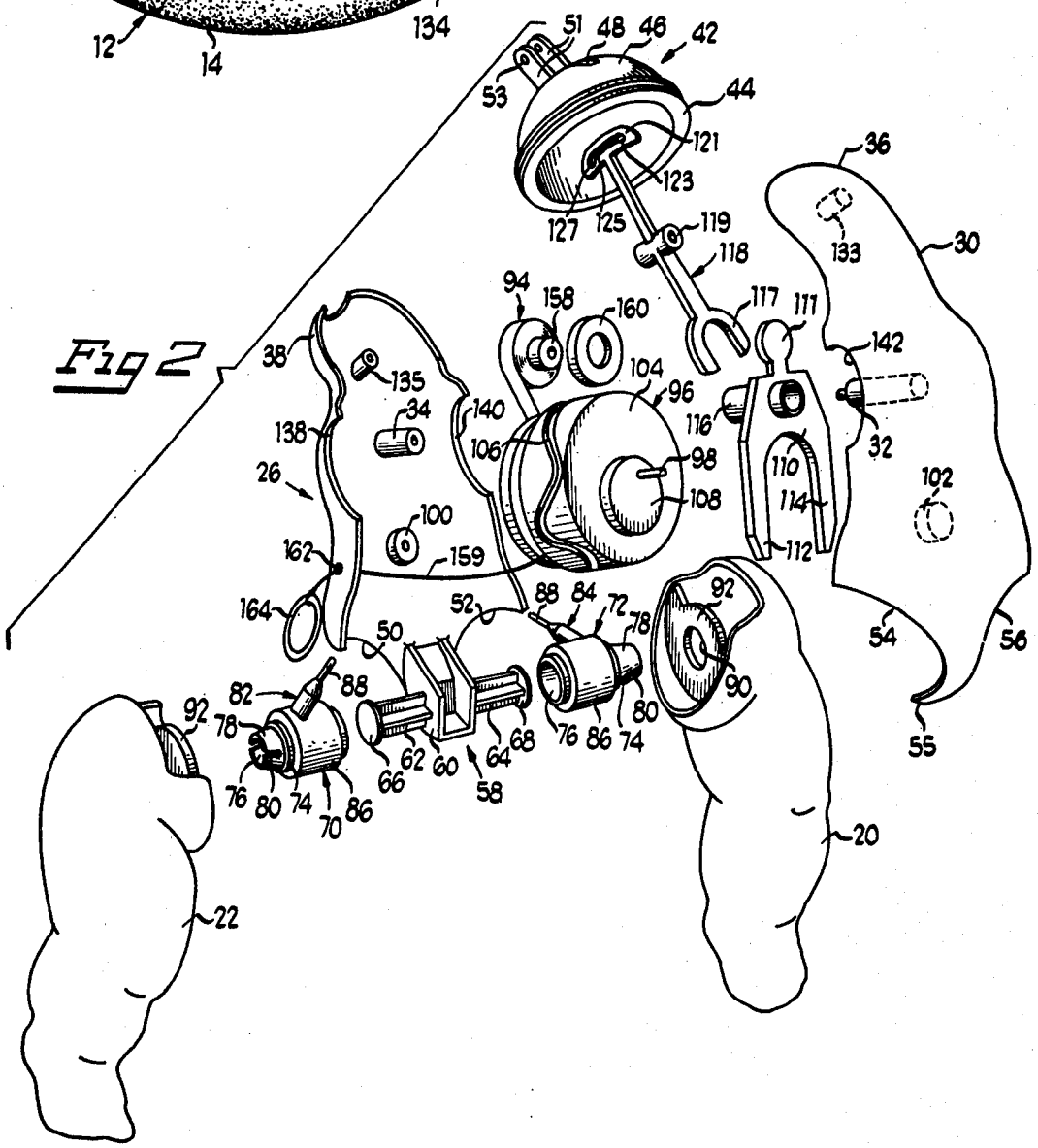
FIG. 2 is an enlarged exploded perspective view of the leg mounting and action assembly.

The toy doll 10 is defined in part by a torso generally designated by the reference numeral 26. The torso 26 includes a back or rear panel 28 and a front panel or member 30. As shown in FIG. 2, the rear 28 and front 30 panels are secured together by a pin 32 that is mounted within a socket 34. The front panel 30 includes a neck portion 36 and the rear panel 28 includes a neck portion 38, together defining an opening 39 in the torso 26. A generally hemispherical head mounting member generally designated by the reference numeral 42 is mounted over the portions 36 and 38, in a ball and socket fashion, for universal rotation with respect to the torso 26. The head mounting member 42 includes an annular flanged ring 44, that frictionally engages the head 24 for relative rotation between the head 24 and ring 44, and an arcuate portion 46 secured to the ring 44. An arcuate slot 48 is defined in a portion of the portion 46. A pair of brackets 51 with apertures 53 extend upwardly from the portion 46 adjacent the slot 48.

Figure 4:
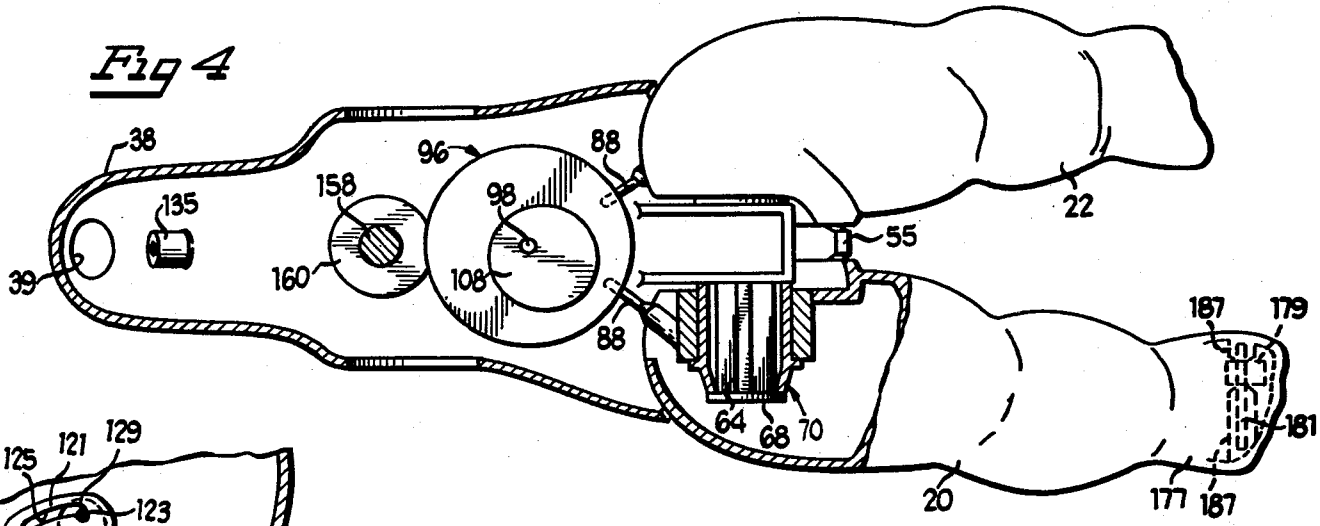
FIG. 4 is an enlarged horizontal cross sectional view of the torso and legs of the doll of the present invention.

The rear panel 28 includes first 50 and second 52 arcuate cut outs and the front panel 30 includes arcuate cut outs 54 and 56, defining an intermediate flange 55, that correspond to the location of the hips on the torso 26. Mounted on the lower portion of the rear panel 28, in accordance with one convenient leg mounting arrangement, is a leg mounting member generally designated by the reference 58. The leg mounting member includes a support extension 60 secured to the back panel 28 and two ribbed posts 62 and 64 extending outwardly from the support member 60. Circular discs 66 and 68 are defined on the ends of the posts 62 and 64, respectively. First 70 and second 72 coupling members are rotatably mounted on the posts 62 and 64. The coupling members 70 and 72 are identical and each includes a tubular body 74 with a bore 76 therethrough. The truncated conical ends 78 extending outwardly from the bodies 74, include slits 80. As best illustrated in FIG. 4, the coupling members 70 and 72 are force fitted over the rods 62 and 64, and the slits 80 allow the truncated cones 78 to spread outwardly over and around the circular discs 66 and 68. The cones 78 snap behind the circular discs 66 and 68 locking the coupling members 70 and 72 onto the posts 62 and 64, respectively.

Mounted on the outer periphery of the coupling members 70 and 72 are cam followers generally designated by the reference numerals 82 and 84. The cam followers 82 and 84 are identical and include an annular ring 86 that encircles and holds the tubular bodies 74 of the coupling members 70, 72. The cam followers 82 and 84 each include a pin 88 directed inwardly of the torso 26.

The legs 20 and 22 are mounted on the ribbed posts 62 and 64 by placing the posts 62 and 64 through apertures 90 defined in a web member 92 within the hip portion of each leg 20 and 22. The legs 20 and 22 are held on the posts 62 and 64 by the connectors 70 and 72 as best illustrated in FIG. 4. This manner of mounting the legs 20 and 22 onto the leg mounting member 58 allows the legs 20 and 22 to pivot independently of each other.

Figure 3:
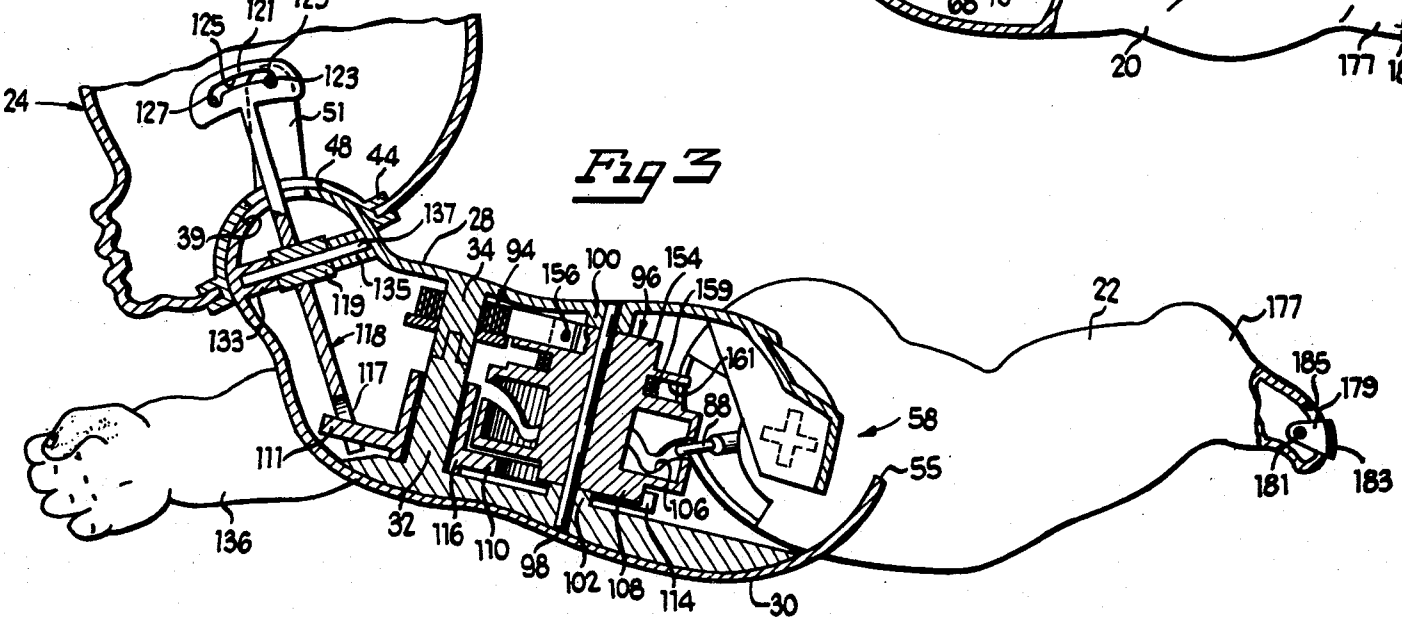
FIG. 3 is an enlarged vertical cross sectional view of the doll of the present invention.

The legs 20 and 22 and the head mounting member 42 are rotated and pivoted by an negator spring 94 and a compound cam 96. As shown in FIG. 3, the compound cam 96 includes an axle or pin 98 that is mounted in a first holder 100 defined on the inner surface of the rear panel 28 and a second holder 102 defined on the inner peripheral surface of the front panel 30. The compound cam 96 defined on the pin 98 includes a first cam 104. An undulating or helical cut or groove 106 is fabricated in the outer periphery of the cam 104. In the preferred embodiment illustrated, the cam 104 is hollow or drum-like and the groove 106 exposes the interior of the cam 104 to the cam follower 88; however a simple indention or groove may also be used in the same configuration as the cut 106 could also be used. Once assembled, the cam followers 88 are positioned within the helical cut 106 as best illustrated in FIGS. 3 and 4.

The compound cam 96 also includes a second cam 108 that is eccentrically defined about the axle pin 98. A clevis shaped cam follower 110 with legs 112 and 114 that engage the outer periphery of eccentrically defined cam 108 is mounted on a tube 116.

Figure 6:
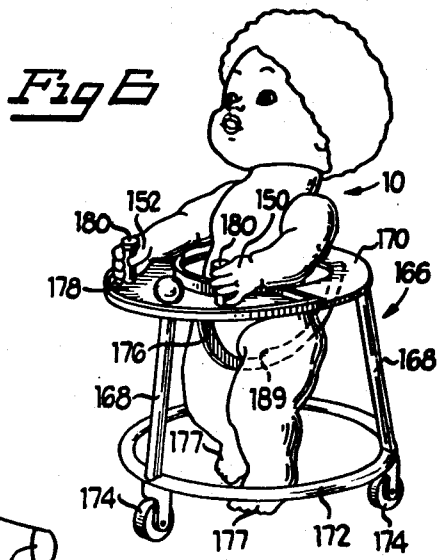
FIG. 6 is a view of the doll mounted in a wheeled vehicle.
Figure 7:
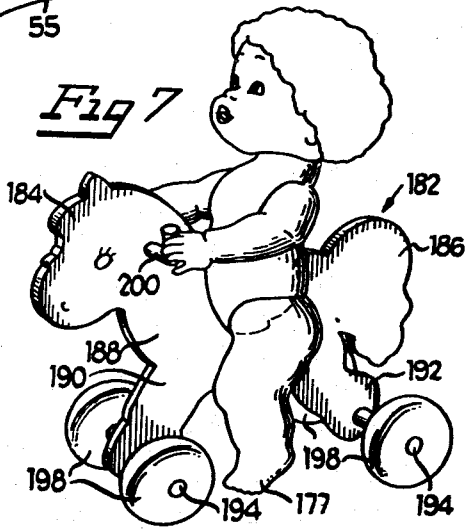
FIG. 7 is a view similar to FIG. 6 with the doll mounted on a different wheeled vehicle.

The tube 116 encircles pin 32 and is thereby pivotally mounted. An elongated pin or cam follower 118 has a fork 117 at the lower end that encircles the head 111 of the follower 110 and extends forwardly into the slot 48 in the portion 46 of the head mounting member 42 (FIG. 3). The pin 118 is pivotally mounted on a hollow socket 119 and a pair of tubes 133 and 135 secured on the inside surface of the torso 26 and encircling a pin 137. The upper end of the pin 118 includes a head 121 with a curved slot 125 having a pair of enlarged ends 123 and 127. The ends 123 and 127 engage a pin 129 that extends between the brackets 51, through the apertures 53. Thus, the head 24 can be fixed in one of two relatively tilted positions by positioning the pin 129 in either of the ends 123 or 127. Positioning the pin 129 in the rearward enlarged end 123 as shown in FIG. 3 places the head in the uplifted position used for swimming as illustrated in FIG. 1. When the pin 129 is positioned in the forward enlarged end 127, the head is moved to a more forward position in which it is more closely aligned with the torso for walking or other generally vertically oriented activities as illustrated in FIGS. 6 and 7.

Figure 5:
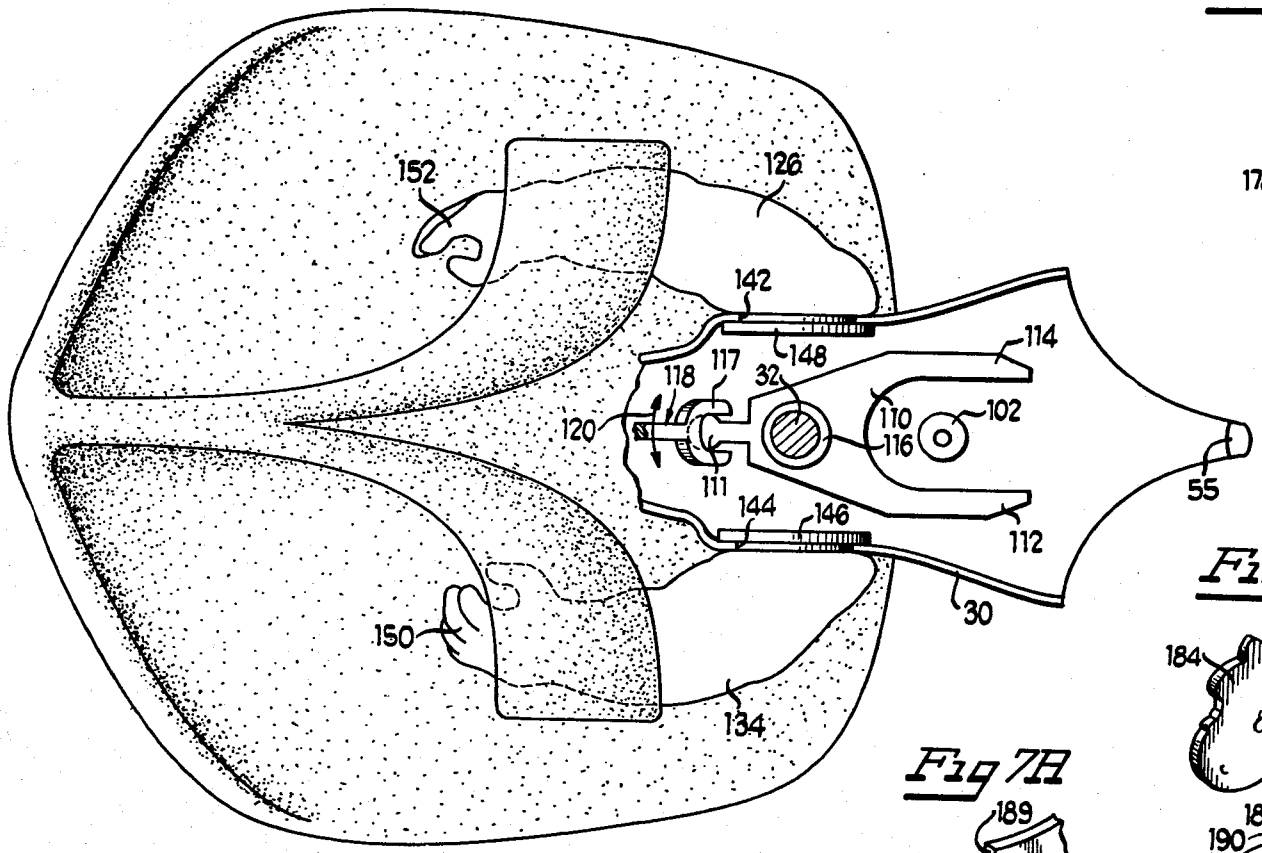
FIG. 5 is an enlarged view of a portion of the doll mounted on a flotation device.

Upon rotation of the compound cam 96, the cam followers 88 follow the cut 106 resulting in an undulating motion of the cam follower 88 that communicates a back and forth out of phase pivoting motion to each of the legs 20 and 22 around an axis defined by the posts 62, 64. This motion corresponds to a kicking action by the legs 20 and 22 in opposite directions similar to that performed by a human during swimming. As this action occurs the cam follower 110 is pivoted by the eccentric cam 108 about the pin 32 causing a pivoting or side to side movement of the pin 118 as indicated by the arrow 120 in FIG. 5. This side to side movement of the pin 118 imparts a side to side pivoting movement of the head mounting member 42 about the pin 137 in either of the two relatively tilted positions.

The head 24 of the doll is mounted on the head mounting member 42 by extending the head mounting member 42 into an aperture defined in the lower portion of the head 24. The rim of the aperture engages the ring 44 of the head mounting member 42 and is held thereon. Thus, the side to side movement of the head mounting member 42 is imparted to the head 24 thereby providing the realistic appearance of side to side movement of the head 24 while the legs 20 and 22 are kicking in opposite directions. This action substantially simulates the action of a child swimming. The head 24 may include hair 124, eyes 126 and 128, a nose 130 and a mouth 132 to provide a realistic appearance.

The doll 10 also includes a pair of arms 134 and 136 that are mounted within apertures defined by cut outs 138 and 140 on the back panel 28 and cut outs 142 and 144 on the front panel 30. The arms 134 and 136 include flanged discs 146 and 148, shown in FIG. 5, at the upper or shoulder end of the arms 134 and 136, rotatably held within the apertures in the torso 26. The friction between the discs 146, 148 and the arms 134, 136 is conveniently sufficiently high to permit the arms 134, 136, manually located in any desired position, to remain in those positions until relocated by the user. The arms 134 and 136 may also include hands 150 and 152, respectively, adding to the realistic appearance of the doll 10.

Although the arms 134 and 136 are manually rotated, the legs 20 and 22 and the head 24 are rotated or pivoted by the negator spring 94 through the compound cam 96. The negator spring 94 is secured to a reduced portion 154 of the compound cam 96 by a rivet 156 (FIG. 3). The negator spring 94 in turn includes a central ring 158 and a washer 160 that encircle the post 34 and thereby mount the negator spring 94 to the torso 26. A string 159 is secured to the compound cam 96 within a groove 161 and extends through an aperture 162 in the rear panel 28 of the torso and is connected to a finger ring 164. As is well known in the art, the finger ring 164 may be grasped and pulled outwardly from the torso 26 causing the negator spring 94 to wrap around the reduced portion 154 of the compound cam 96. Once the negator spring 94 is completely unwrapped from the reduced portion 154 of the compound cam 96, the string 159 can no longer be pulled outwardly and upon release, the negator spring 94 wraps around the ring 158 thereby rotating the compound cam 96 which in turn imparts kicking action to the legs 20 and 22 and side to side motion to the head 24.

As previously described, the doll 10, conveniently in its arms forward position, may be secured to the flotation device 12 by forcing the arms 134 and 136 of the doll 10 beneath the handles 16 and 18 of the device 12. The handles 16, 18 are then biased against the arms 134 and 136 to securely connect the device 12 to the upper underside of the doll 10. The doll 10 and flotation device 12 float when placed in a body of water such as a bathtub; however, the legs 20, 22 are slightly immersed due to the location of the device 12 near the upper end of the doll 10. Upon pulling the finger ring 164 the negator spring 94 will cause a kicking action of the legs 20, 22 and a side to side motion of the uplifted head 24 resulting in the doll 10 propelling itself over the body of water. Conveniently, the doll 10 is made predominately of plastic parts so that water seepage into the doll does no damage. In fact, some water seepage into the doll 10, for example, through the hip cut outs 50–56, is advantageous since this helps to immerse the legs 20, 22 into the water, so that the doll 10 is propelled by the kicking action of the legs 20, 22. At the same time, the forward, underside positioning of the device 12 prevents sinking while further encouraging the immersion of the legs 20, 22.

Figure 7A:
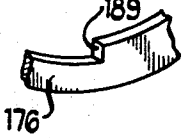

Referring now to FIGS. 6 and 7, the doll 10 with its head in the forward position may also be mounted in a generally vertical orientation on a wheeled vehicle and through the action of the legs 20 and 22 may be propelled across a surface. In FIG. 6, there is illustrated a wheeled stroller 166 including legs 168 extending between a top annular ring 170 and a lower annular ring 172. Wheels 174 are pivotally mounted at the lower end of the legs 168 allowing the wheeled vehicle 166 to move over a surface. An annular support ring 176 is secured to the annular ring 170 such that the doll 10 may be seated on the ring 176 by extending the legs 22 and 20 and the torso 26 of the doll 10 through the center of the ring 170 and positioning the legs 20 and 22 on opposite sides of the support ring 176. A notch 189 (FIG. 7A) is defined on the ring 176 to stabilize the doll in a walking position, preventing slippage by engaging the flange 55. The dimensions of the legs 168 are such that their feet 177 engage the surface such as the floor or the like on which the wheeled device 166 is positioned. As shown in FIG. 3, the feet 177 include pivotally mounted shoes 179, pivotal, with respect to pins 181 held in brackets 187, along a slot 185 in each foot 177. The ground contacting surface 183 is a rubber traction pad. The annular ring 170 may include a tray 178 with handles 180 defined thereon that may be grasped by the hands 150 and 152 of the doll 10. Thereafter the negator spring 94 is extended, pivoting the head from side to side and propelling the legs 20 and 22 through the kicking action which will propel the doll 10 and the wheeled device 166 across the surface. The doll 10 pivots from side to side on the ring 176, shifting its weight onto the leg in contact with the ground and ready to move rearwardly, so that the leg moving forwardly does not contact the ground. Traction for forward movement is provided by the surface 183, retracted during forward leg movement. This action is facilitated by the forward inclination of the feet 177 which causes the weight shift to occur when the rearwardly moving foot has passed the center point on its arc of movement, thereby allowing the forwardly moving foot 177 to reach its forward position before the weight is shifted onto it.

Another wheeled device 182 is illustrated in FIG. 7. This wheeled device 182 is formed in the configuration of a pony with a head 184, a tail 186, a body 188 and legs 190 and 192. Axles 194 extend through apertures defined in the legs 190 and 192 and wheels 198 are mounted on the axles 194 allowing the vehicle 182 to move over a surface. The vehicle 182 includes handles 200 that may be attached to the hands 150 and 152 of the doll 10. The legs 20 and 22 of the doll 10 may straddle each side of the wheeled vehicle 182 and be mounted on the body 188 such that the bottom of the legs 20, 22 engage a surface such as a floor or the like. As can be understood, in a manner similar to the action of the wheeled vehicle 166 in FIG. 6, if the negator spring 94 is elongated, the legs 20 and 22 go through a kicking motion tending to propel the doll 10 and the wheeled vehicle 182 across the surface.

It will be understood that the above description of a specific embodiment is by way of illustration only and is not to be construed as limiting the present invention to that specific embodiment.

What is claimed and sought to be secured by Letters Patent of the United States is:

1. A toy doll, comprising:

a torso having an upper end and a lower end;

a pair of legs;

means for mounting each leg of said pair of legs adjacent said lower end of said torso for pivotal movement about an axis generally transverse to the length from said lower end to said upper end of said torso;

means for simultaneously pivoting each leg of said pair of legs in opposite directions;

means for mounting a head onto said torso for side to side pivotal movement about a pin that is at an angle to said length and said axis including a generally hemispherical head mounting member mounted adjacent the upper end of said torso in a ball and socket fashion for movement with respect to the torso;

means for connecting said simultaneous pivoting means to said means for mounting said head, to cause said head to pivot from side to side in a timed relationship with the movement of said legs;

said connecting means including a first and second cam follower, said first cam follower engaging said simultaneous pivoting means, said second cam follower engaging said first cam follower, and said second cam follower being connected to said head and to said member; and said connection between said second cam follower and said head including means which permits positioning said head in one of at least two tilted positions by manually moving the head in a direction substantially transverse to the side to side pivotal movement of said head.

2. The toy doll set forth in claim 1 wherein said simultaneous pivoting means includes a compound cam rotatably mounted in said torso and which includes an undulating groove, and each leg of said pair of leg includes a cam groove follower secured to each leg and positioned in said undulating groove.

3. The toy doll set forth in claim 1 wherein said simultaneous pivoting means includes an eccentrically mounted cam.

4. The toy doll set forth in claim 1 including a pair of rotatable arms.

5. The toy doll set forth in claim 4 including a flotation device, said flotation device including means securable to the outstretched arms of said doll.

6. The toy doll set forth in claim 1 including a flotation device, said flotation device having means releasably securable to said doll adjacent said upper end of said torso to support said head and said upper end on water and permitting immersion of said legs in the water.

7. The toy doll set forth in claim 1 further comprising a wheeled vehicle including at least one wheel and means for mounting said toy doll thereon.

8. The toy doll set forth in claim 7 wherein said mounting means includes a support extendable between said legs, arranged to allow side-to-side pivotal movement of said doll atop said support shifting the weight of the doll onto the leg in contact with the ground so that the other leg may move without contacting the ground.

9. The toy doll set forth in claim 7 wherein said torso includes a flange intermediate said means for mounting each leg of said pair of legs and said support includes a notch that engages said flange.

10. The toy doll set forth in claim 1 wherein said first cam follower pivots about a second pin and said second cam follower pivots about a third pin.

11. A toy action doll comprising:

a torso having an upper end, a lower end, a front, a back, and sides;

a pair of arms;

means attaching each arm to a side of the torso intermediate the ends of the arm for rotation relative to the torso;

a pair of legs;

means mounting each leg adjacent the lower end of the torso for pivotal movement of each leg from front to back;

a head;

means mounting the head adjacent the upper end of the torso for side to side pivotal movement and front to back tilting of the head between a first uplifted position and a second forward position;

a flotation device, said flotation device including means allowing the flotation device to be releasably securable to said doll adjacent said upper end of said torso to support said head in said first uplifted position and said upper end on water and permitting immersion of said legs in the water;

driving means for simultaneously pivoting each leg in opposed front to back movement and pivoting said head from side to side in timed relation with the pivoting of said legs with said head in said first uplifted position and to propel said doll and said flotation device through the water; and said driving means simultaneously pivoting each leg in opposed front to back movement and pivoting said head from side to side in timed relationship with the pivoting of said legs with said head in said second forward position whereby said doll can propel itself across a generally horizontal surface with said torso held in a generally vertical position with the aid of external support.

12. The toy doll set forth in claim 11 further comprising a wheeled vehicle including at least one wheel and means for mounting said toy doll thereon.

13. The toy doll set forth in claim 12 wherein said mounting means includes a support extendable between said legs, arranged to allow side to side pivotal movement of said doll atop said support shifting the weight of the doll onto the leg in contact with the ground so that the other leg may move without contacting the ground.

14. The toy doll set forth in claim 11 wherein said means for mounting said head includes a generally hemispherical head mounting member mounted adjacent the upper end of said torso in a ball and socket fashion for movement with respect to the torso.

15. The toy doll set forth in claim 11 wherein said simultaneous pivoting means includes a compound cam rotatably mounted in said torso and which includes an undulating groove, and each leg of said pair of legs includes a cam groove follower secured to each leg and positioned in said undulating groove.

* * * * *